US007942309B2

(12) United States Patent
Liang

(10) Patent No.: US 7,942,309 B2
(45) Date of Patent: May 17, 2011

(54) BOX SEALING BELT

(75) Inventor: Yu-Chieh Liang, Taipei County (TW)

(73) Assignee: Quanta Computer Inc., Tao Yuan Shien (TW)

( * ) Notice: Subject to any disclaimer, the term of this patent is extended or adjusted under 35 U.S.C. 154(b) by 201 days.

(21) Appl. No.: 12/346,786

(22) Filed: Dec. 30, 2008

(65) Prior Publication Data

US 2010/0059582 A1 Mar. 11, 2010

(30) Foreign Application Priority Data

Sep. 10, 2008 (TW) ..... 97134734 A

(51) Int. Cl.
*B65D 5/46* (2006.01)
*B65D 43/22* (2006.01)

(52) U.S. Cl. ..... 229/117.25; 24/302; 24/458; 220/318; 220/768; 220/770; 229/125.39

(58) Field of Classification Search ..... 229/125.37, 229/125, 38, 125.39, 125.41, 117.25; 24/298, 24/302, 458; 220/315, 318, 323, 756, 759, 220/768, 770, 775; 16/425
See application file for complete search history.

(56) References Cited

U.S. PATENT DOCUMENTS

| | | | | | |
|---|---|---|---|---|---|
| 820,301 | A | * | 5/1906 | Hale | 229/104 |
| 933,454 | A | * | 9/1909 | Hudson | 229/125.39 |
| 2,645,408 | A | * | 7/1953 | Eckles | 229/117.19 |
| 2,742,679 | A | * | 4/1956 | Young | 49/463 |
| 3,194,462 | A | * | 7/1965 | Tupper | 294/170 |
| 3,221,977 | A | * | 12/1965 | Pollert | 229/117.23 |
| 3,276,663 | A | * | 10/1966 | Falconer | 229/117.24 |
| 3,686,717 | A | * | 8/1972 | Merser | 24/298 |
| 3,927,812 | A | * | 12/1975 | Winters et al. | 220/759 |
| 4,067,493 | A | * | 1/1978 | Stavin | 229/117.25 |
| 4,398,381 | A | | 8/1983 | Ulrich et al. | |
| 5,219,116 | A | * | 6/1993 | Hearne | 229/118 |

FOREIGN PATENT DOCUMENTS

| | | | |
|---|---|---|---|
| CN | 2484263 | Y | 4/2002 |
| CN | 1420061 | A | 5/2003 |
| GB | 2 444 719 | A | 6/2008 |
| JP | 2004-175451 | | 6/2004 |
| JP | 2005-8269 | | 1/2005 |
| TW | 422208 | | 2/2001 |
| TW | 479653 | | 3/2002 |
| TW | 200633908 | | 10/2006 |
| TW | 200720162 | | 6/2007 |
| TW | M322393 | | 11/2007 |

* cited by examiner

*Primary Examiner* — Gary E Elkins

(74) *Attorney, Agent, or Firm* — Rabin & Berdo, PC

(57) ABSTRACT

A box sealing belt includes two sealing bands, a gap band and two fastening ears. The two sealing bands are substantially in parallel with each other. The gap band is interconnected between the two sealing bands to form two opposing concave slots therebetween. The two fastening ears are respectively disposed at two opposite ends of either one of the two sealing bands.

7 Claims, 5 Drawing Sheets

BOX SEALING BELT

RELATED APPLICATIONS

This application claims priority to Taiwan Application Serial Number 97134734, filed Sep. 10, 2008, which are herein incorporated by reference.

BACKGROUND

1. Field of Invention

The present invention relates to a box sealing device. More particularly, the present invention relates to a reusable box sealing device.

2. Description of Related Art

FIG. 1 illustrates a conventional paperboard box sealing method. A paperboard box 102 was usually sealed by using a tape 106 to secure two covers (104*a*; 104*b*) together. Such way is quite convenient, but the tape cannot be reused to seal the next paperboard box. Moreover, the tape 106 may damage the paperboard box surfaces, i.e. the paper surface may be abraded by the tape 106. For the forgoing reasons, there is a need for improving the paperboard box sealing method.

SUMMARY

It is therefore an objective of the present invention to provide a box sealing belt.

In accordance with the foregoing and other objectives of the present invention, a box sealing belt includes two sealing bands, a gap band and two fastening ears. The two sealing bands are substantially in parallel with each other. The gap band is interconnected between the two sealing bands to form two opposing concave slots therebetween. The two fastening ears are respectively disposed on two opposite ends of either one of the two sealing bands.

In accordance with the foregoing and other objectives of the present invention, a box with box sealing mechanism includes a hollow box and a sealing belt. The hollow box has two covers and two sealing silts. The sealing belt is used to seal the hollow box. The sealing belt includes the following components. Two sealing bands are substantially in parallel with each other. A gap band is interconnected between the two sealing bands to form two opposing concave slots therebetween for enclosingly engaging edges of the two covers. Two fastening ears are respectively disposed on two opposite ends of either one of the two sealing bands and operable to be respectively inserted into the two sealing silts.

In accordance with the foregoing and other objectives of the present invention, a box sealing belt includes two sealing bands, a gap band and two fastening ears. The two sealing bands are substantially in parallel with each other. The gap band is interconnected between the two sealing bands to form two opposing concave slots therebetween. The first fastening ear is secured to one end of either one of the two sealing bands. The handle has an end secured to either one of the two sealing bands and an opposite end being a second fastening ear.

Thus, the present invention provides a box sealing belt to seal a box instead of using a tape for achieving the same. The box sealing belt is reusable and causes fewer damages to a paperboard box than the tape does.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
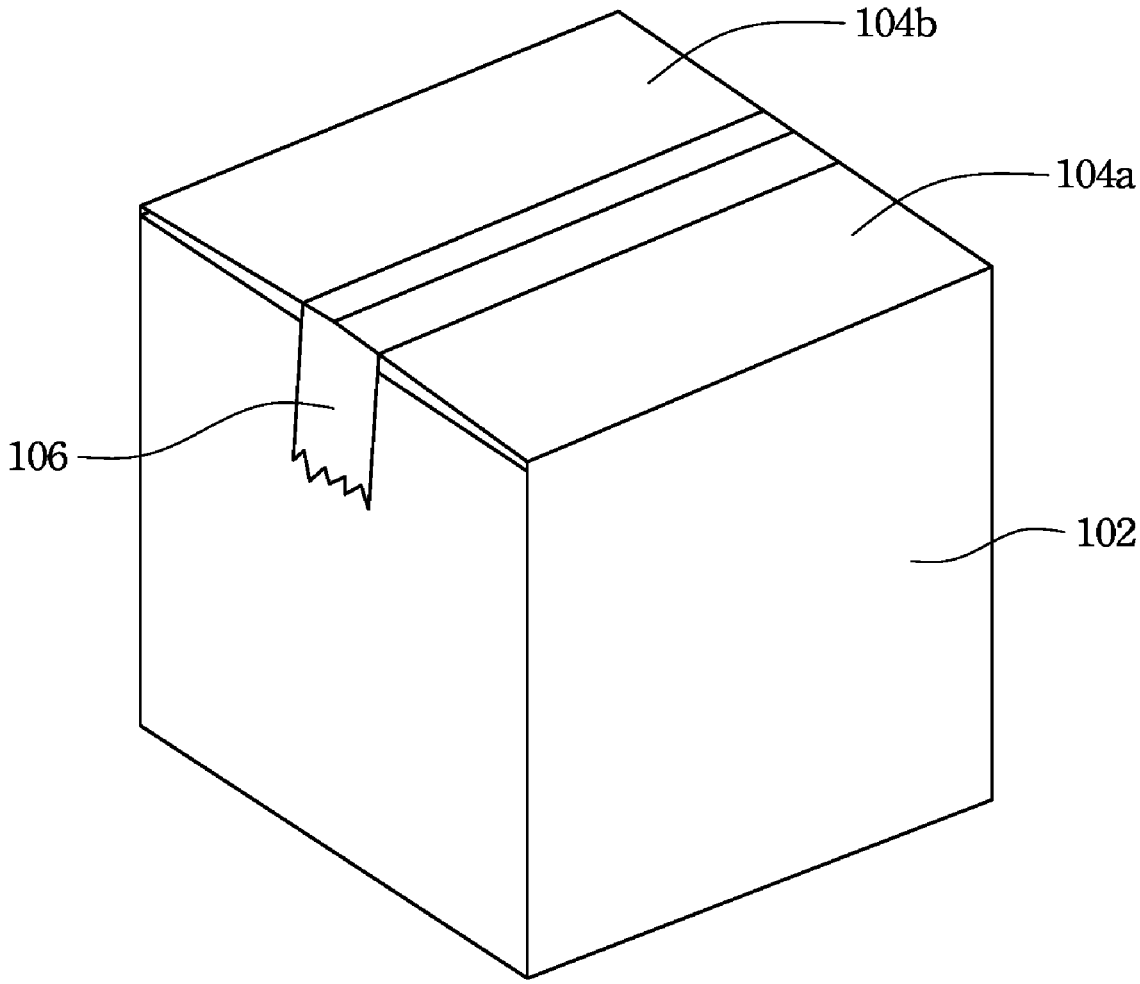
Fig. 1 (PRIOR ART)
FIG. 1 illustrates a conventional paperboard box sealing method.

Reference will now be made in detail to the present preferred embodiments of the invention, examples of which are illustrated in the accompanying drawings. Wherever possible, the same reference numbers are used in the drawings and the description to refer to the same or like parts.

Figure 2:
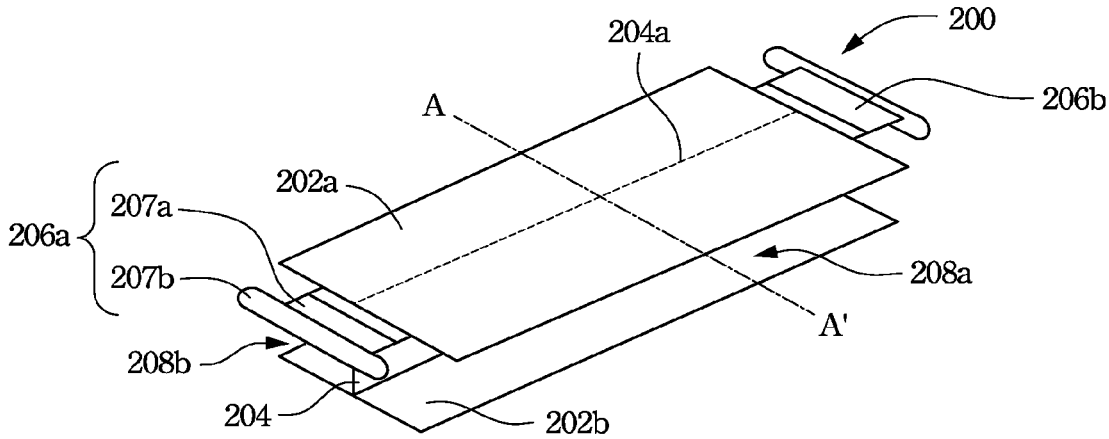
FIG. 2 illustrates a box sealing belt according to one preferred embodiment of this invention.
Figure 2A:
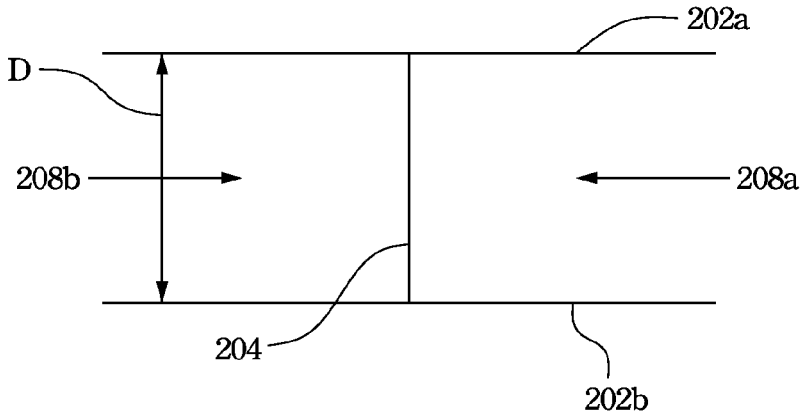
FIG. 2A illustrates a cross-sectional view (taken along A-A') of the box sealing belt as illustrated in FIG. 2.

FIG. 2 illustrates a box sealing belt according to one preferred embodiment of this invention. FIG. 2A illustrates a cross-sectional view (taken along A-A') of the box sealing belt as illustrated in FIG. 2. A box sealing belt 200 is reusable sealing belt, which includes sealing bands (202*a*; 202*b*), a gap band 204 and fastening ears (206*a*; 206*b*). In this embodiment, the sealing bands (202*a*; 202*b*) are substantially of the same shape and size, and substantially in parallel with each other. In this embodiment, the two sealing bands are made from plastic materials in the shape of long flat strips. The gap band 204 is interconnected between the sealing bands (202*a*; 202*b*) to substantially form a cross-section of a symbol "工" (a Chinese character). That is, two opposing concave slots (208*a*; 208*b*) are formed therebetween, i.e. between the sealing bands (202*a*; 202*b*). Because the gap band 204 is interconnected at the middle of the sealing bands (202*a*; 202*b*), the two opposing concave slots (208*a*; 208*b*) are substantially of the same size. For example, the sealing band 202*a* is divided into two areas of the same size by a virtual line 204*a*, where the gap band 204 is connected to the sealing band 202*a*. Similarly, the sealing band 202*b* is divided into two areas of the same size by a virtual line (not shown), where the gap band 204 is connected to the sealing band 202*b*. The fastening ears (206*a*; 206*b*) can be designed at two ends respectively of either one of the sealing bands (202*a*; 202*b*). In FIG. 2, the fastening ears (206*a*; 206*b*) are designed at two ends respectively of the sealing band 202*a*. Each fastening ear consists of two portions, a connect portion 207*a* and an enlarged end 207*b*, wherein the enlarged end 207*b* has a larger width than the connect portion 207*b* has. The connect portion 207*a* can be made of flexible materials, which can be bent or twisted for readily inserting the enlarged end 207*b* into sealing silts (222*a*; 222*b*) of the paperboard box 220 (see FIG. 4).

Figure 3:
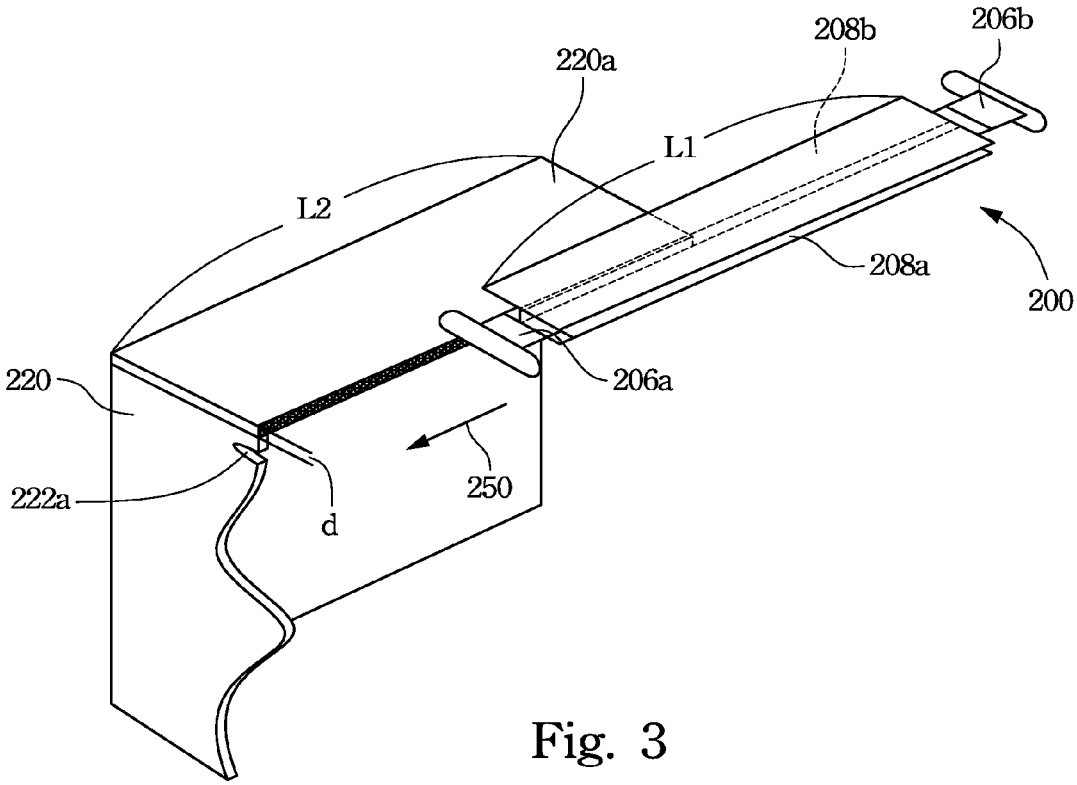
FIG. 3 illustrates how to apply a box sealing belt to a paperboard box according to one preferred embodiment of this invention.
Figure 4:
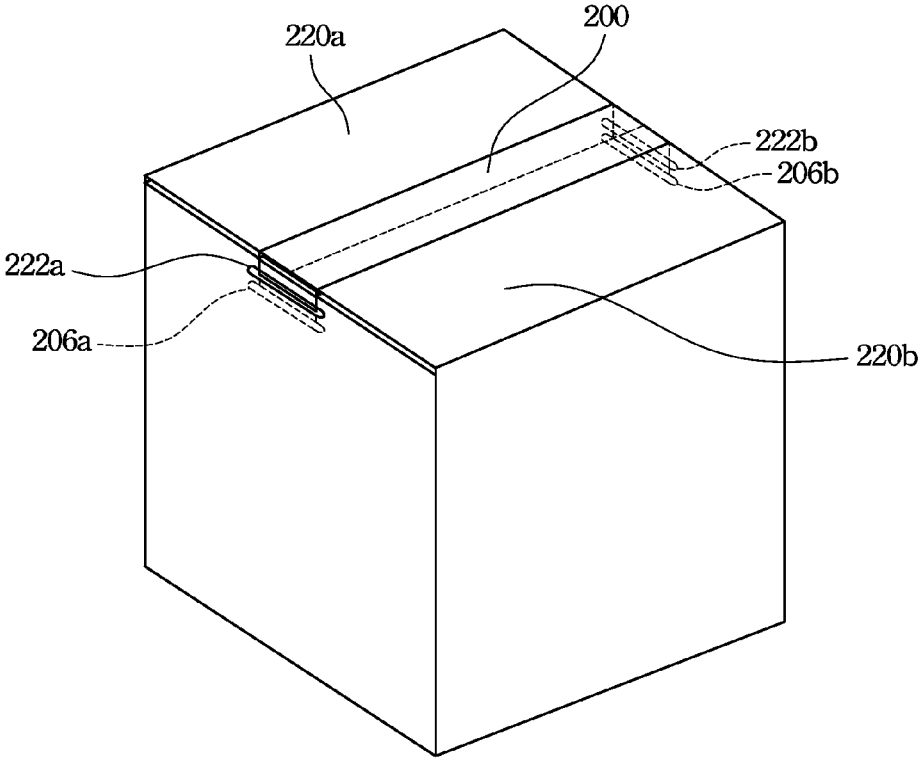
FIG. 4 illustrates a paperboard box sealed by the box sealing belt as illustrated in FIG. 2.

Referring to FIG. 2A, FIG. 3 and FIG. 4, wherein FIG. 3 illustrates how to apply a box sealing belt to a paperboard box according to one preferred embodiment of this invention (half paperboard box is illustrated for easily clarifying how the box sealing belt 200 is used). The paperboard box 220 at least has two covers (220*a*; 220*b*) and two sealing silts (222*a*; 222*b*). When the two covers (220*a*; 220*b*) are desired to be sealed, two concave slots (208*a*; 208*b*) of the sealing belt 200 enclosingly engage edges of the two covers (220*a*; 220*b*) respectively. Referring to FIG. 3, the sealing belt 200 is slid along a direction 250 until the concave slot 208*b* fully engages the edge of the cover 220*a*. Meanwhile, the concave slot 208*a* fully engages the edge of the cover 220*b*. Next, the fastening ears (206*a*; 206*b*) can be respectively inserted into the two sealing silts (222*a*; 222*b*) on two opposite box walls of the box 220 (see FIG. 4) so as to seal the box 220. The enlarged ends of the fastening ears (206*a*; 206*b*) has larger widths than the two sealing silts (222*a*; 222*b*) has. Thus, the enlarged ends (such as 207*b* in FIG. 2) of the fastening ears (206*a*; 206*b*) would not be pulled out of the two sealing silts (222*a*; 222*b*) after the enlarged ends are inserted into the two sealing silts (222*a*; 222*b*). In this embodiment, an interval (D) between the sealing bands (202*a*; 202*b*) is substantially equal to a thickness (d) of the covers (220*a*; 220*b*). A length of the box sealing belt 200 is substantially equal to a length of the covers (220*a*; 220*b*).

Figure 5:
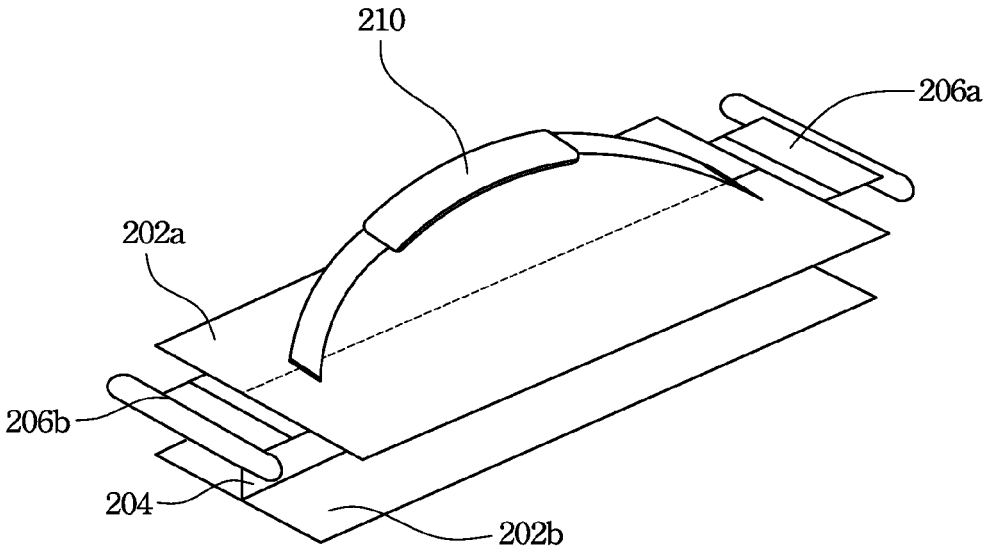
FIG. 5 illustrates a box sealing belt with a handle according to another preferred embodiment of this invention.
Figure 6:
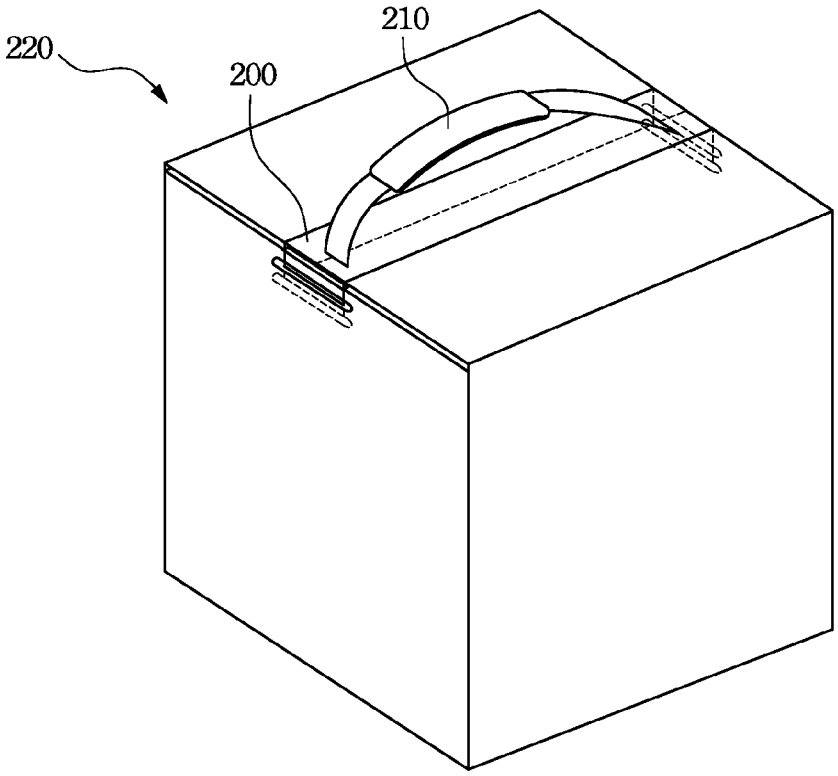
FIG. 6 illustrates a paperboard box sealed by the box sealing belt as illustrated in FIG. 5.

Referring to FIG. 5 and FIG. 6, the box sealing belt can further include a handle 210 for users to carry the sealed box conveniently.

Figure 7:
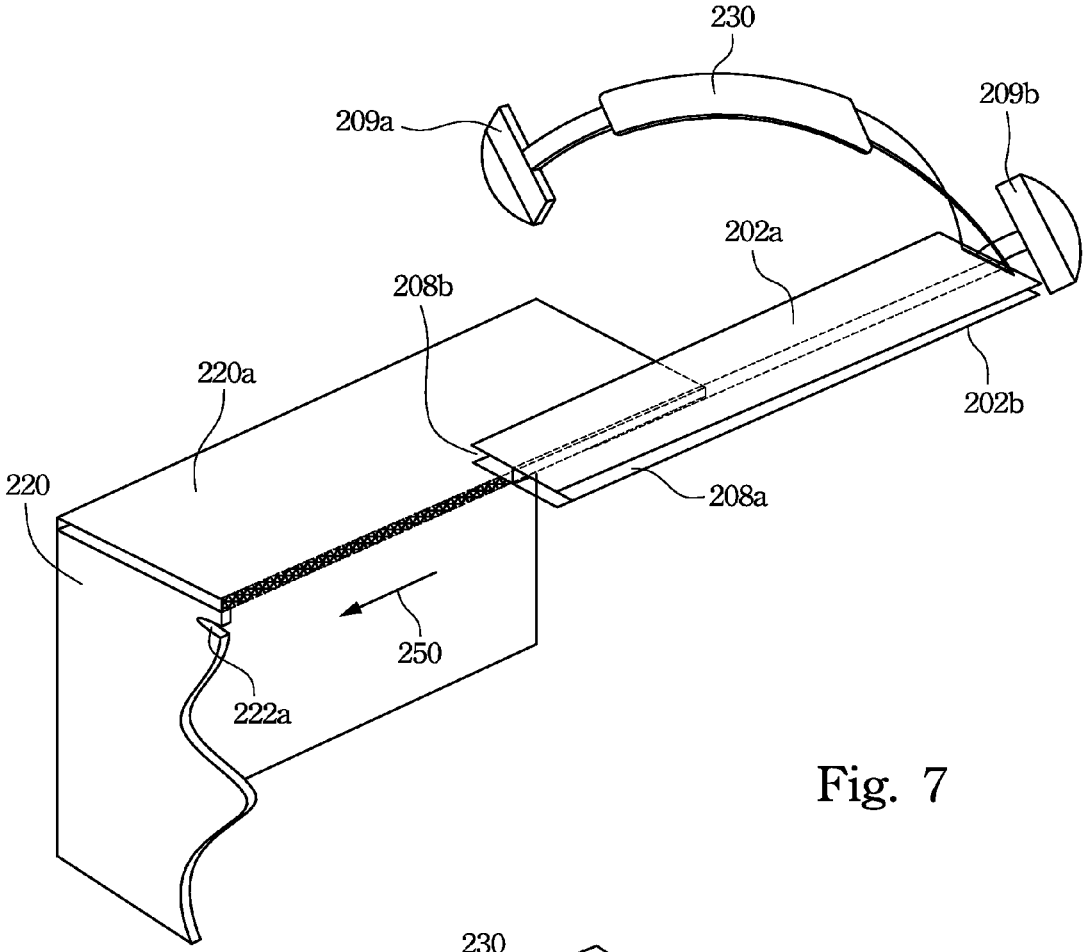
FIG. 7 illustrates a box sealing belt with a handle according to still another preferred embodiment of this invention.
Figure 8:
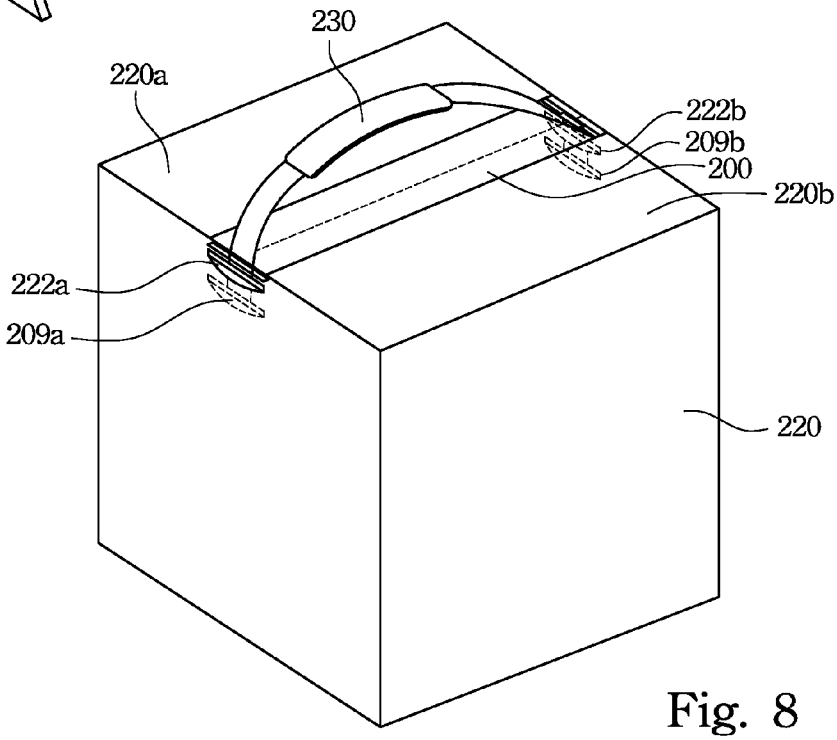
FIG. 8 illustrates a paperboard box sealed by the box sealing belt as illustrated in FIG. 7.

FIG. 7 illustrates a box sealing belt with a handle according to still another preferred embodiment of this invention (half paperboard box is illustrated for easily clarifying how the box sealing belt is used). The differences between embodiments illustrated in FIG. 5 and FIG. 7 lie in fastening ears. In this embodiment, the fastening ear 209*b* and one end of the handle 230 are secured to an end of the sealing band 202*a* (same as the embodiment in FIG. 5), the fastening ear 209*a* is at opposite end of the handle 230 (different from the embodiment in FIG. 5). When the two covers (220*a*; 220*b*) are desired to be sealed, two concave slots (208*a*; 208*b*) of the sealing belt 200 enclosingly engage edges of the two covers (220*a*; 220*b*) respectively. Referring to FIG. 7, the sealing belt is slid along a direction 250 until the concave slot 208*b* fully engages the edge of the cover 220*a*, i.e. all the edge of the cover 220*a* is within the concave slot 208*b*. Meanwhile, the concave slot 208*a* fully engages the edge of the cover 220*b*, i.e. all the edge of the cover 220*b* is within the concave slot 208*a*. Next, the two fastening ears (209*a*; 209*b*) can be respectively inserted into the two sealing silts (222*a*; 222*b*) on two opposite box walls of the box 220 (see FIG. 8) so as to seal the box 220.

According to discussed embodiments, the present invention provides a box sealing belt to seal a box instead of using a tape for achieving the same. The box sealing belt is reusable and causes fewer damages to a paperboard box than the tape does.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A box sealing belt, comprising:

two sealing bands substantially in parallel with each other;

a gap band interconnected between the two sealing bands to form two opposing concave slots therebetween;

a first fastening ear secured to one end of either one of the two sealing bands; and a handle having an end secured to either one of the two sealing bands and an opposite end being a second fastening ear.

2. The box sealing belt of claim 1, wherein the two sealing bands are of the same shape and size.

3. The box sealing belt of claim 2, wherein the two sealing bands are long flat strips.

4. The box sealing belt of claim 1, wherein an interval between the two sealing bands is substantially equal to a thickness of a cover of a box, which is desired to be sealed by the box sealing belt.

5. The box sealing belt of claim 1, wherein the two sealing bands are made from plastic materials.

6. The box sealing belt of claim 1, wherein the end of the handle and the first fastening ear are secured to the same end of either one of the two sealing bands.

7. The box sealing belt of claim 1, wherein the gap band is interconnected between the two sealing bands to substantially form a cross-section of a symbol "I".

* * * * *